US010553191B2

(12) United States Patent
Shan et al.

(10) Patent No.: US 10,553,191 B2
(45) Date of Patent: Feb. 4, 2020

(54) SOUND GENERATING APPARATUS, ELECTRIC DEVICE AND METHOD FOR MANUFACTURING THE SAME

(71) Applicant: GOERTEK INC., Weifang, Shandong (CN)

(72) Inventors: Lianwen Shan, Weifang (CN); Xinfeng Yang, Weifang (CN); Hairong Wang, Weifang (CN); Longhao Cui, Weifang (CN)

(73) Assignee: GOERTEK INC., Weifang, Shandong ( * ) Notice: Subject to any disclaimer, the term of this patent is extended or adjusted under 35 U.S.C. 154(b) by 0 days.

(21) Appl. No.: 15/573,693

(22) PCT Filed: Nov. 18, 2015

(86) PCT No.: PCT/CN2015/094952
§ 371 (c)(1),
(2) Date: Nov. 13, 2017

(87) PCT Pub. No.: WO2016/184061
PCT Pub. Date: Nov. 24, 2016

(65) Prior Publication Data

US 2018/0108337 A1 Apr. 19, 2018

(30) Foreign Application Priority Data

May 21, 2015 (CN) ..... 2015 1 0264418

(51) Int. Cl.
*G10K 9/122* (2006.01)
*H04R 1/28* (2006.01)
*H04R 17/00* (2006.01)

(52) U.S. Cl.
CPC ..... *G10K 9/122* (2013.01); *H04R 1/2811* (2013.01); *H04R 17/00* (2013.01)

(58) Field of Classification Search
CPC ... H04R 2217/00–2217/03; H04R 1/00; H04R 2205/022; H04R 2201/401; H04R 2201/405
USPC ..... 381/190, 182
See application file for complete search history.

(56) References Cited

U.S. PATENT DOCUMENTS 3,748,502 A * 7/1973 Bernstein ..... B06B 1/0655 310/319
4,190,783 A * 2/1980 Massa ..... G10K 9/122 310/324
4,497,981 A * 2/1985 House ..... H04R 23/02 181/144
4,554,414 A * 11/1985 House ..... H04R 23/02 181/144
5,193,119 A * 3/1993 Tontini ..... H04R 1/24 381/182
6,108,429 A * 8/2000 Nakamura ..... H04R 1/2811 381/152
8,548,187 B2 * 10/2013 Yu ..... H04R 1/1008 381/190
9,693,132 B2 * 6/2017 Goossens ..... H04R 31/00
(Continued)

*Primary Examiner* — Suhan Ni

(57) ABSTRACT

The present invention discloses a sound generating apparatus, an electrode device and a method for manufacturing the same. The sound generating apparatus includes a sound generating member, a piezoelectric buzzer and a front cover, wherein the front cover is attached to the front of the sound generating member, and the piezoelectric buzzer is attached to the front cover.

5 Claims, 8 Drawing Sheets

(56) References Cited

U.S. PATENT DOCUMENTS

| | | | | |
|---|---|---|---|---|
| 2004/0047478 | A1* | 3/2004 | Combest | H04R 1/24<br>381/182 |
| 2016/0105749 | A1* | 4/2016 | Qutub | H04R 7/06<br>381/190 |

* cited by examiner

SOUND GENERATING APPARATUS, ELECTRIC DEVICE AND METHOD FOR MANUFACTURING THE SAME

CROSS-REFERENCE TO RELATED APPLICATIONS

This application is a National Stage of International Application No. PCT/CN2015/094952, filed on Nov. 18, 2015, which claims priority to Chinese Patent Application No. 201510264418.8, filed on May 21, 2015, both of which are hereby incorporated by reference in their entireties.

FIELD OF THE INVENTION

The present invention relates to the field of sound generating apparatuses, and more particularly, to a sound generating apparatus, an electronic device, and a method for manufacturing the same.

BACKGROUND OF THE INVENTION

A sound generating apparatus is an apparatus capable of converting an electric signal into a sound signal. The sound generating apparatus includes, for example, a receiver. For example, a moving-coil receiver and a loudspeaker may be called receivers. The sound generating apparatus is widely applied in a media device. For example, the media device includes, for example, a mobile phone and an earphone thereof.

A high-frequency performance is an important performance of the sound generating apparatus. In general, a frequency response curve of the moving-coil receiver will drop rapidly within a range of 6 kHz to 9 kHz. The frequency response curve of a typical loudspeaker will also drop after tens of kilohertz. In other words, the frequency response curve of the sound generating apparatus will have a high-frequency cut-off frequency. With the development of technologies, requirements for the high-frequency cut-off frequency of the sound generating apparatus are getting higher and higher. However, due to limitations of materials and a production process of the sound generating apparatus, in particular limitations of materials and a production process of the moving-coil receiver, the high-frequency cut off frequency of the sound generating apparatus is difficult to increase.

With the wide application of 4G communications, it is required to have the sound generating apparatus equipped with an ultra-wide frequency band. For example, in some cases, the high-frequency cut off frequency of the sound generating apparatus is required to reach above 16 kHz. However, for example, it is very difficult to reach this requirement for a common moving-coil receiver.

SUMMARY OF THE INVENTION

The present invention is directed to provide a novel sound generating apparatus.

According to one embodiment of the present invention, there is provided a sound generating apparatus, including a sound generating member, a piezoelectric buzzer and a front cover, wherein the front cover is attached to the front of the sound generating member and the piezoelectric buzzer is attached to the front cover.

Optionally, the sound generating apparatus is a moving-coil receiver, and the sound generating member is a moving-coil sound generating portion of the moving-coil receiver.

Optionally, a resonant frequency of the piezoelectric buzzer is less than or equal to a high-frequency cutoff frequency of the sound generating member.

Optionally, the piezoelectric buzzer is annular, the front cover is annular, and the sound generating member and the front cover form a Helmholtz resonator.

Optionally, an annular opening of the front cover is sized such that a resonant frequency of the Helmholtz resonator is identical to that of the piezoelectric buzzer.

Optionally, there is a gap between the piezoelectric buzzer and the front cover.

Optionally, the piezoelectric buzzer is clung to the front cover.

Optionally, the piezoelectric buzzer is located on the inner side of the front cover.

According to another embodiment of the present invention, there is provided an electronic device, including the sound generating apparatus according to the present invention.

According to another embodiment of the present invention, there is provided a method for manufacturing a sound generating apparatus, wherein the sound generating apparatus includes a sound generating member, a piezoelectric buzzer and a front cover, and the sound generating member and the front cover form a Helmholtz resonator. The method includes the following steps: attaching the piezoelectric buzzer to the front cover, wherein the piezoelectric buzzer is annular and the front cover is annular; determining a resonant frequency of the Helmholtz resonator according to a resonant frequency of the piezoelectric buzzer to determine a size of an annular opening of the front cover; and attaching the front cover to the front of the sound generating member.

The inventors of the present invention have found that, in the prior art, high frequency characteristics of a sound generating member are not compensated with a piezoelectric buzzer, and the prior art has not recognized that a compensation effect may be enhanced by an interaction between the piezoelectric buzzer and a front cover. Therefore, a technical task to be implemented by or the technical problem to be solved by the present invention has not been conceived or anticipated by a person skilled in the art and thus the present invention is a new technical solution.

In addition, it should be understood by those skilled in the art that although there are many problems in the prior art, the technical solution of each of the embodiments or claims of the present invention improves the prior art in only one or several aspects without having to simultaneously address all technical problems listed in the prior art or background art. It should be understood by those skilled in the art that the content not mentioned in a claim should not be construed as limiting this claim.

Further features of the present invention and advantages thereof will become apparent from the following detailed description of exemplary embodiments according to the present invention with reference to the attached drawings.

BRIEF DESCRIPTION OF THE DRAWINGS

The accompanying drawings, which are incorporated in and constitute a part of the specification, illustrate embodiments of the present invention and, together with the description thereof, serve to explain the principles of the present invention.

DETAILED DESCRIPTION OF THE EMBODIMENTS

Figure 1:
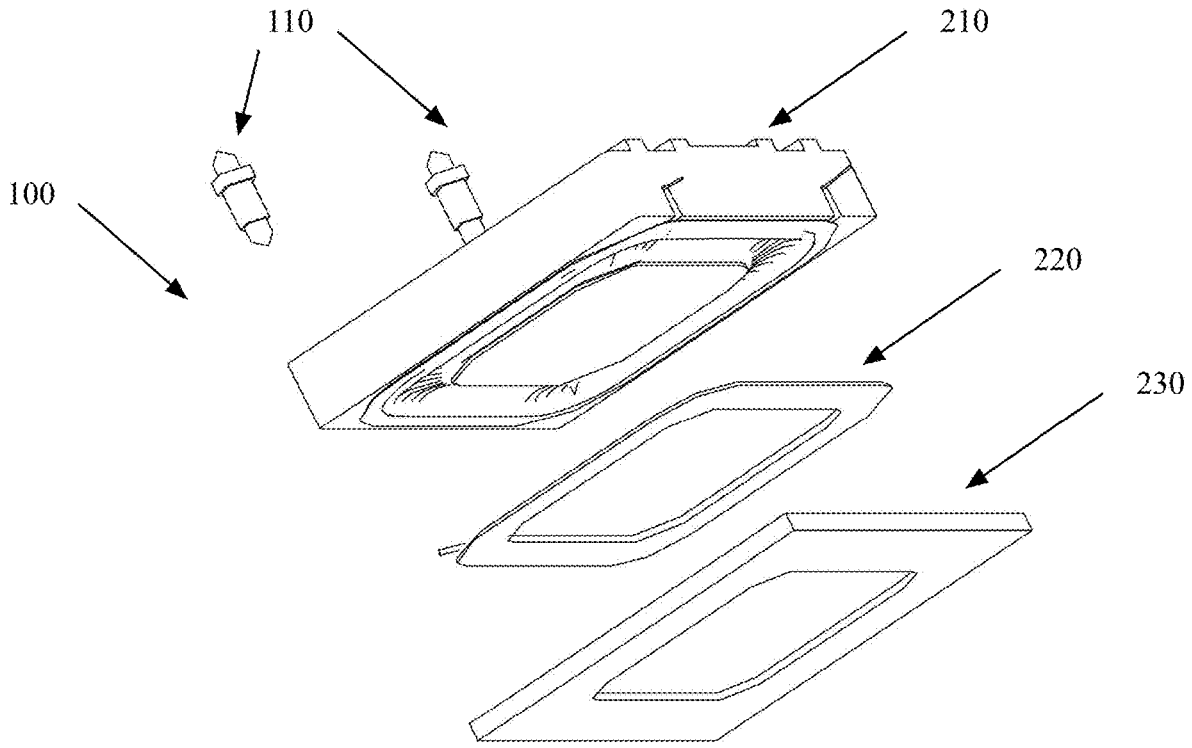
FIG. 1 is an exploded perspective view of a sound generating apparatus as viewed laterally from below according to one embodiment of the present invention.

Various exemplary embodiments of the present invention will now be described in detail with reference to the drawings. It should he noted that the relative arrangement of the components and steps, the numerical expressions, and numerical values set forth in these embodiments do not limit the scope of the present invention unless it is specifically stated otherwise.

The following description of at least one exemplary embodiment is merely illustrative in nature and is in no way intended to limit the invention, its application, or uses.

Techniques, methods and apparatus as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it does not need to be further discussed for following figures.

Embodiments and examples according to the present invention will be described below with reference to the accompanying drawings.

FIG. 1 shows an exploded perspective view of a sound generating apparatus 100 as viewed laterally from below according to one embodiment of the present invention.

As shown in FIG. 1, the sound generating apparatus 100 includes a sound generating member 210, a piezoelectric buzzer 220, and a front cover 230.

The front cover 230 may be attached to the front of the sound generating member 210. The piezoelectric buzzer 220 is attached to the front cover 230.

For example, the sound generating apparatus 100 is a moving-coil receiver. In this case, the sound generating member 210 is a moving-coil sound generating portion of the moving-coil receiver.

It should be understood by those skilled in the art that the piezoelectric buzzer 220 is a sound generating body with piezoelectric ceramics as an electro-acoustic transducer. Such a means is a transduction replacement, that is, a piezoelectric element, formed by attaching a piezoelectric ceramic flake to a metal sheet. The piezoelectric buzzer does not produce radio frequency noise during working, and has characteristics of low power consumption and the like.

A resonant frequency of the piezoelectric buzzer may be between 1 kHz and 40 kHz. It is easy to mount the piezoelectric buzzer due to its small volume. The piezoelectric buzzer has a very large sound volume at the resonant frequency or higher. The piezoelectric buzzer is additionally disposed in the sound generating apparatus. An appropriate resonant frequency of the piezoelectric buzzer is selected, so that the piezoelectric buzzer and the sound generating member in the sound generating apparatus can work at the same time, which may compensate for a high-frequency response characteristic of the sound generating apparatus. A compensated superimposed frequency response of the sound generating apparatus can perform well at 20 kHz or even 40 kHz, effectively increasing the high-frequency cutoff frequency of the sound generating apparatus and improving the high-frequency performance of the sound generating apparatus.

In the present invention, the front cover is disposed in the sound generating apparatus. On the one hand, the front cover may protect the sound generating apparatus. On the other hand, in the present invention, the piezoelectric buzzer is attached to the front cover. Due to an interaction between the piezoelectric buzzer and the front cover, the frequency compensation effect can be improved.

For example, there may be a gap between the piezoelectric buzzer and the front cover, or the piezoelectric buzzer may be clung to the front cover, so long as the piezoelectric buzzer can interact with the front cover during working.

In one example, the piezoelectric buzzer is located on the inner side of the front cover to protect the piezoelectric buzzer by means of the front cover.

Preferably, the front cover is made of plastics or other insulating materials. The front cover may be insulated from the piezoelectric buzzer.

In one example, the sound generating apparatus 100 further includes a first input line and a second input line. The first input line is configured to provide a first input signal to the sound generating member. The second input line is configured to provide a second input signal different from the first input signal to the piezoelectric buzzer. For example, input voltages of the sound generating member and piezoelectric buzzer are different. By providing the first input line and the second input line, respectively, the sound generating member and the piezoelectric buzzer can be operated at the optimum state simultaneously.

For example, the second input line may include a Pogo Pin connector 110.

For example, the piezoelectric buzzer may be annular. It should be understood by those skilled in the art that the annular shape refers to a periphery-closed and middle-opened shape. For example, the annular shape includes a circular ring shape, a square ring shape or the like. In addition, the piezoelectric buzzer may also be a part of the annular shape.

For example, the front cover may also be annular. In this case, the sound generating member 210 and the front cover 230 (and the piezoelectric buzzer 220 attached to the front cover) form a Helmholtz resonator. An annular opening of the front cover may be sized such that a resonant frequency of the Helmholtz resonator is identical to that of the piezoelectric buzzer and the piezoelectric buzzer obtains a higher sound pressure level near the resonant frequency.

For example, the annular opening of the front cover may be sized such that the resonant frequency of the Helmholtz resonator may be greater than 10 kHz, preferably greater than 16 kHz, and more preferably greater than 20 kHz.

Figure 12:
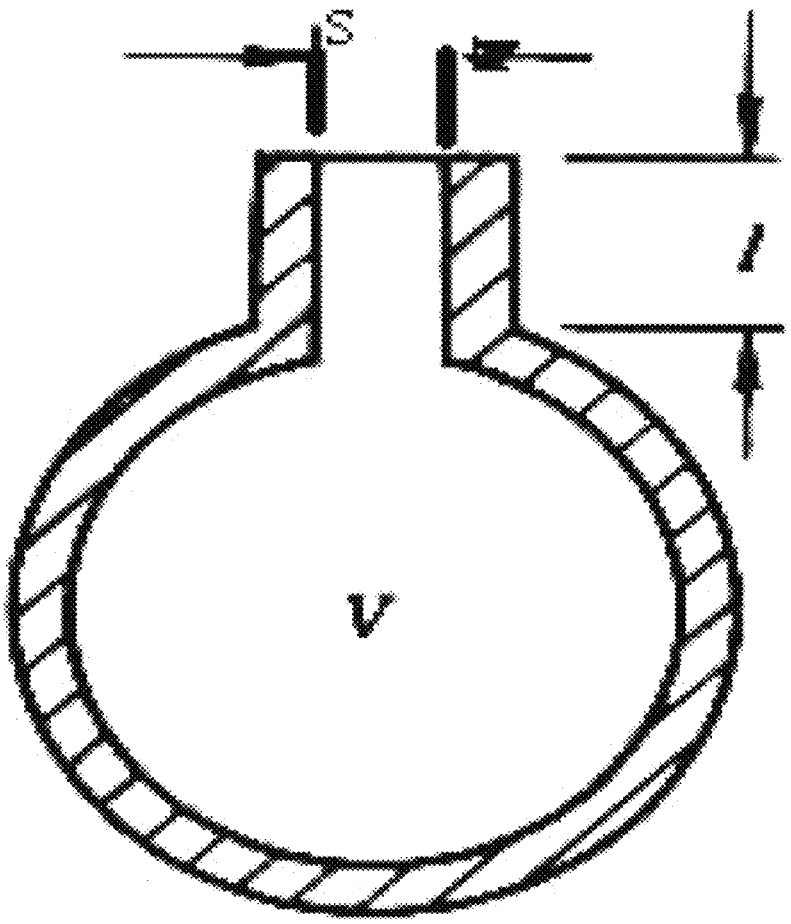
FIG. 12 shows a model of a Helmholtz resonator.

Since a space between the front cover and the sound generating member is substantially fixed after the sound generating apparatus is designed, adjusting a size of the front cover is a relatively convenient manner of adjusting the resonant frequency of the Helmholtz resonator formed by the front cover and the sound generating member. How to determine the resonant frequency of the Helmholtz resonator is known to those skilled in the art. In the following, a formula for calculating the resonant frequency for the annular front cover is illustrated by way of an example only:

$$f_0 = \frac{c}{2\pi}\sqrt{\frac{S}{(l+0.5d)V}} \quad \text{(formula 1)}$$

wherein f0 is the resonant frequency of the Helmholtz resonator, S is an area of a sound outlet of the front cover, d is a diameter of the sound outlet, l is a length of the sound outlet, V is a volume of air, and C is a velocity of sound. A model of the Helmholtz resonator is as shown in FIG. 12. The model and the calculating formula of the Helmholtz resonator are known in the art and are not of interest in the present invention, and thus arc not described further in detail herein.

Figure 2:
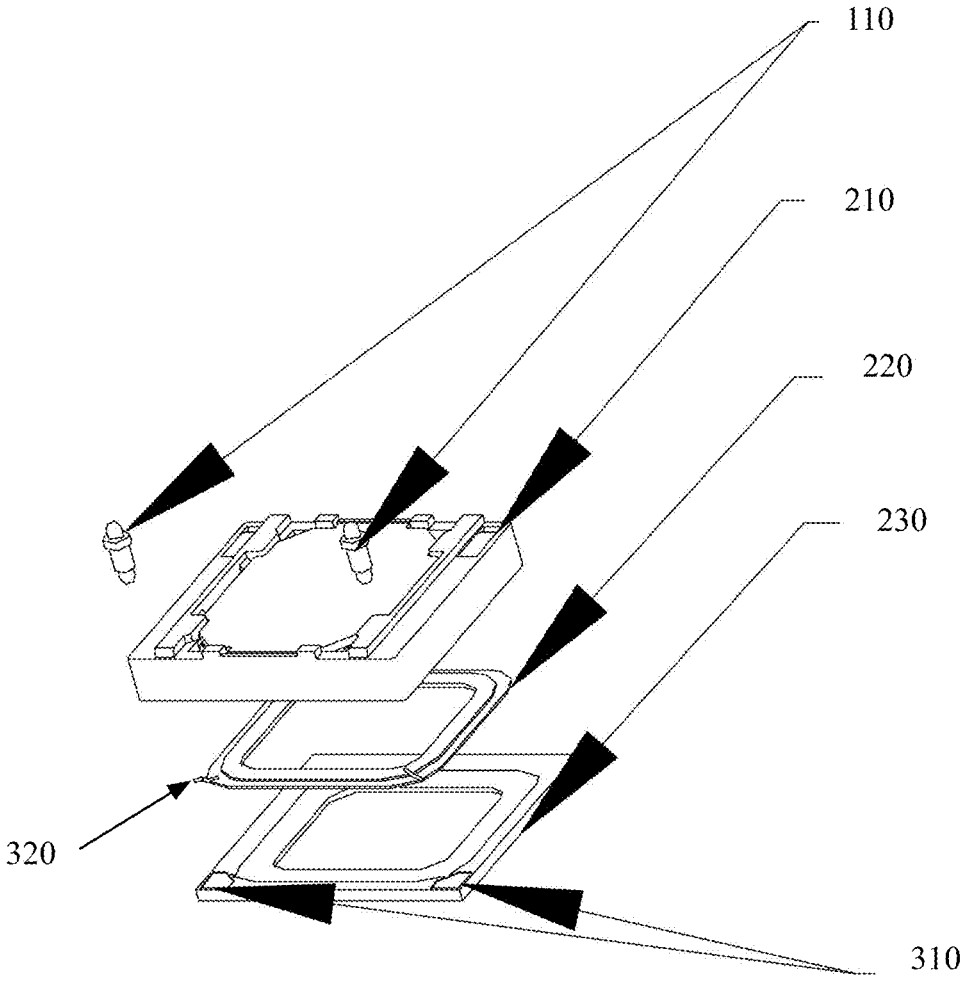
FIG. 2 is an exploded perspective view of a sound generating apparatus as viewed laterally from above according to one embodiment of the present invention.

FIG. 2 is an exploded perspective view of a sound generating apparatus as viewed laterally from above according to one embodiment of the present invention.

As shown in FIG. 2, the sound generating apparatus 100 includes a sound generating member 210, a piezoelectric buzzer 220 and a front cover 230.

A Pogo Pin connector 110 in a second input line is also shown in FIG. 2.

Two Pogo Pin connectors may be formed within the sound generating member by means of injection molding. Alternatively, other connection manners may be used as well. For example, a spring or an elastic sheet may be used for connection. Alternatively, a flexible circuit board may be used for connection.

As shown in FIG. 2, a second pad 310 is further disposed on the front cover. The piezoelectric buzzer has a connection line 320 for being connected to the second pad. The Pogo Pin connector is connected to the second pad to transfer a second input signal. For example, the Pogo Pin connector is formed by means of injection molding. For example, a through hole may be formed in a position, corresponding to the Pogo Pin connector, on the sound generating member so that the Pogo Pin connector is connected to the second pad through the through hole.

Figure 3:
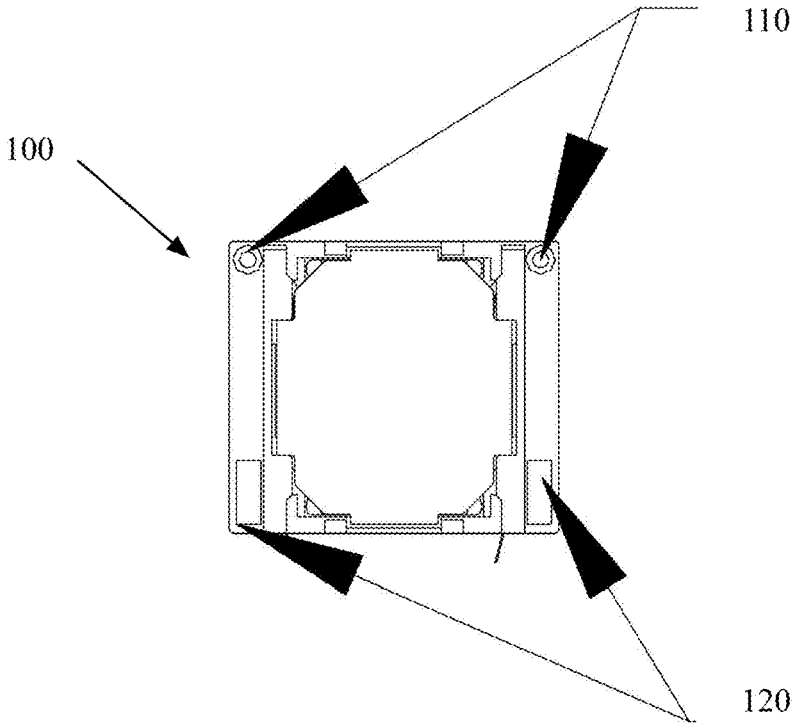
FIG. 3 is a top view of a sound generating apparatus according to one embodiment of the present invention.

FIG. 3 is a top view of a sound generating apparatus according to one embodiment of the present invention.

FIG. 3 shows a view of a sound generating apparatus 100 as viewed from a sound generating member side. As shown in FIG. 3, the sound generating apparatus 100 includes a POGO PIN connector 110 and a first pad 120. For example, the first pad 120 is a part of a first input line, which is configured to transfer a first input signal. By means of the first pad, an input signal may be provided to the sound generating member 210 such that the sound generating member 210 can generate sounds.

Figure 4:
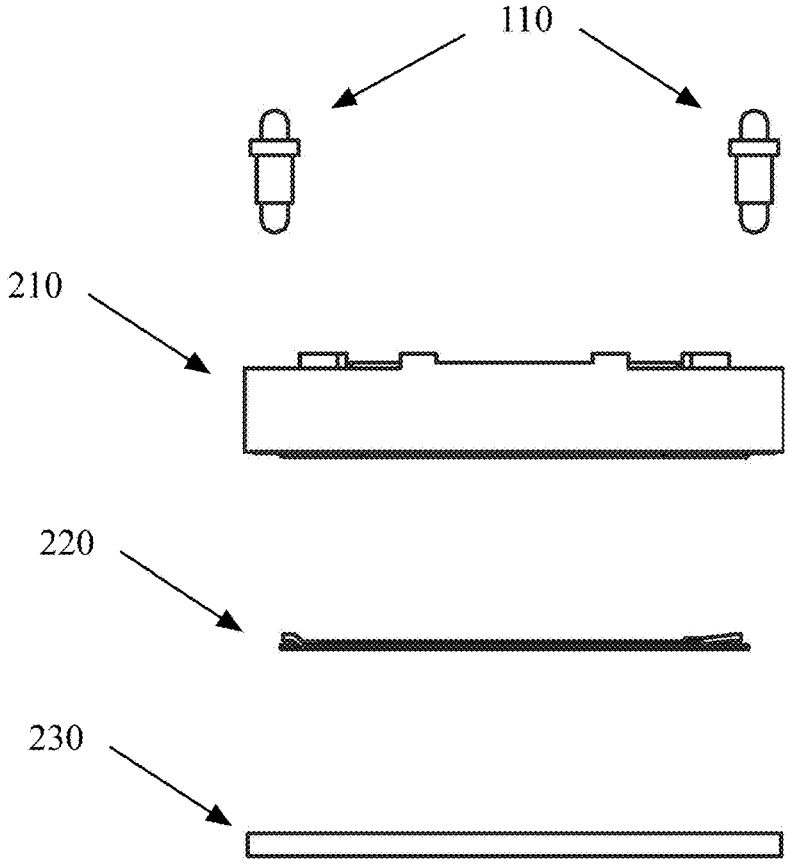
FIG. 4 is an exploded view of a sound generating apparatus as laterally viewed according to one embodiment of the present invention.

FIG. 4 shows an exploded view of a sound generating apparatus as viewed from the side according to one embodiment of the present invention.

As shown in FIG. 4, the sound generating apparatus includes a POGO PIN connector 110, a sound generating member 210, a piezoelectric buzzer 220 and a front cover 230. For example, a lead is disposed on the piezoelectric buzzer 220 for being connected to the pad on the front cover 230, and an input signal may be received through a POGO PIN.

Figure 5:
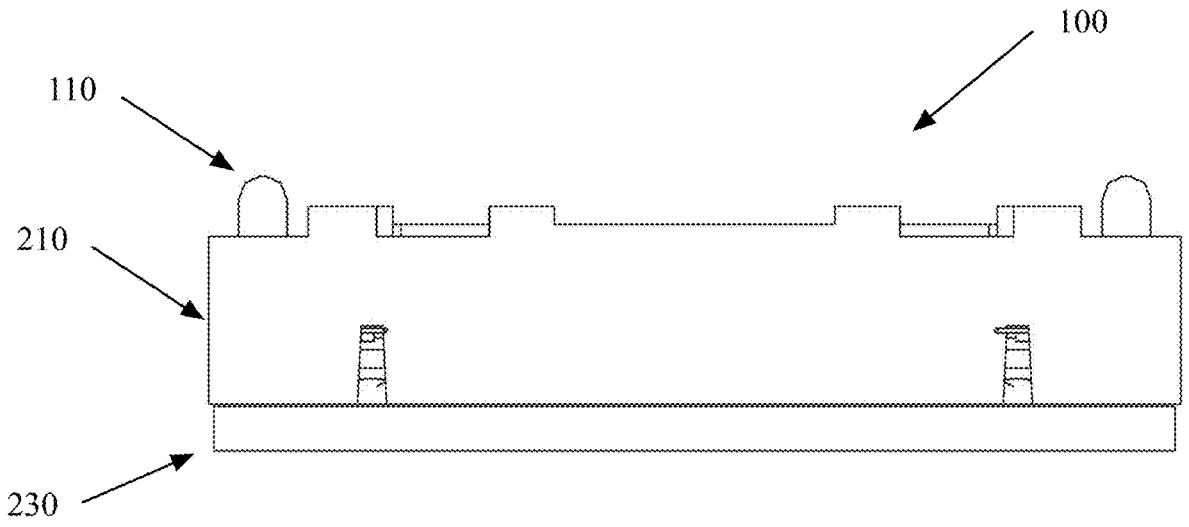
FIG. 5 is a side view of a sound generating apparatus according to one embodiment of the present invention.

FIG. 5 is a side view of a sound generating apparatus according to one embodiment of the present invention. A POGO PIN connector 110, a sound generating member 210 and a front cover 230 of the sound generating apparatus 100 are shown in FIG. 5. A piezoelectric buzzer is attached to the inner side of the front cover 230, so that it is not shown in FIG. 5.

Figure 6:
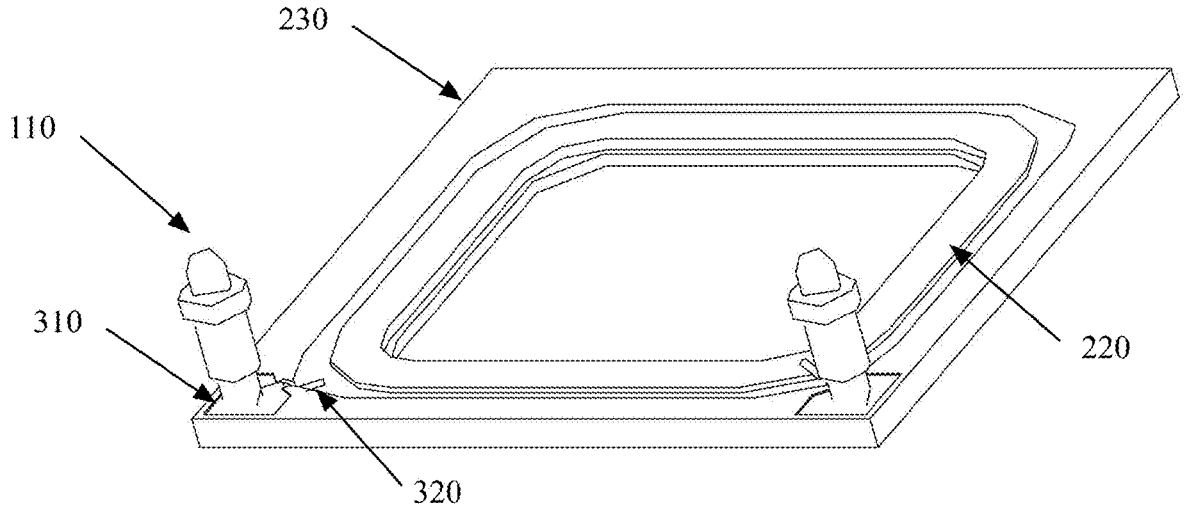
FIG. 6 is a schematic diagram of a connection between a Pogo Pin connector and a piezoelectric buzzer of a sound generating apparatus (a sound generating member is omitted) according to one embodiment of the present invention.

FIG. 6 shows a schematic diagram of a connection between a Pogo Pin connector and a piezoelectric buzzer of a sound generating apparatus according to one embodiment of the present invention. For convenience of explanation, a sound generating member is omitted in FIG. 6. FIG. 6 shows a view as viewed obliquely from above. As shown in FIG. 6, a second pad 310 is disposed on the front cover 230. The second pad 310 may be formed by means of injection molding. A Pogo Pin connector 110 is connected to the second pad 310. The Pogo Pin connector 110 may also be formed by means of injection molding. A piezoelectric buzzer 220 is connected to the second pad 310 through a lead 320.

Figure 7:
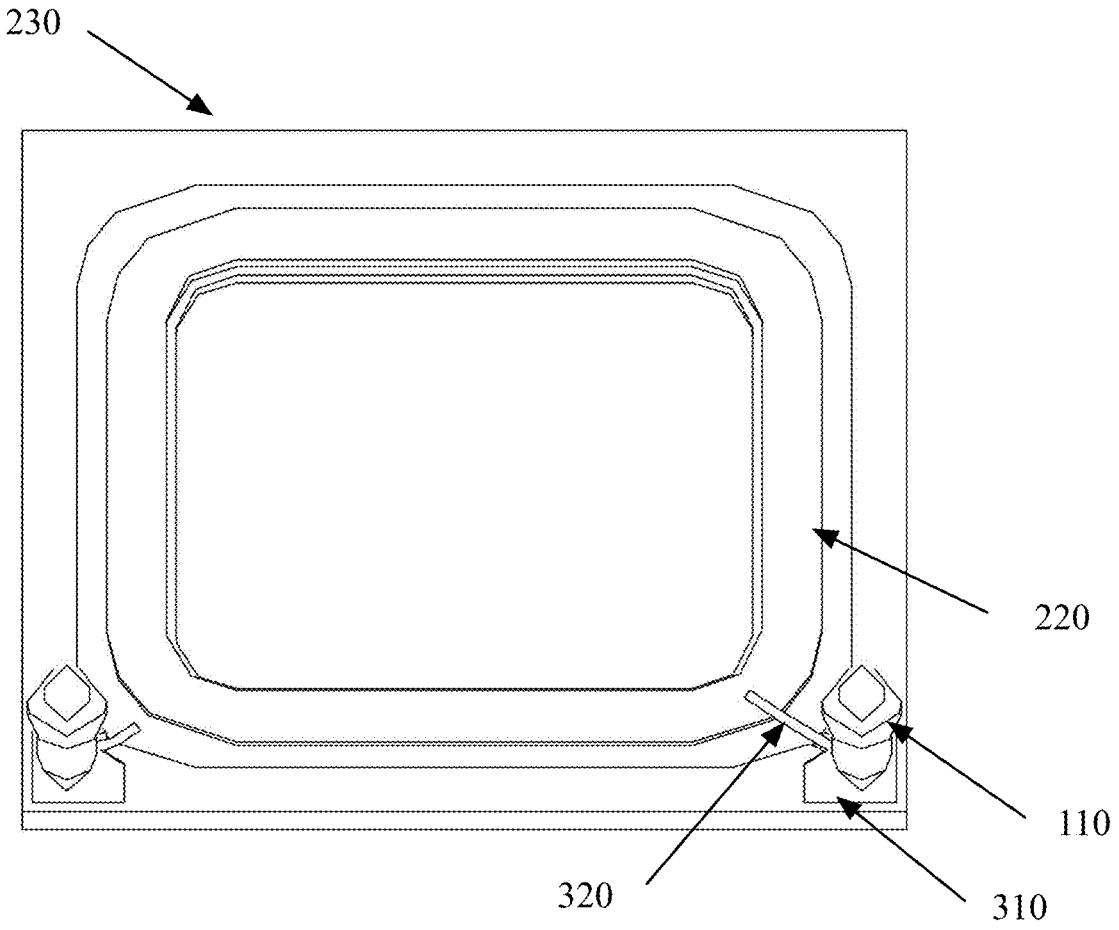
FIG. 7 is another schematic diagram of a connection between a Pogo Pin connector and a piezoelectric buzzer of a sound generating apparatus (a sound generating member is omitted) according to one embodiment of the present invention.

FIG. 7 is another schematic diagram of a connection between a Pogo Pin connector and a piezoelectric buzzer of a sound generating apparatus according to one embodiment of the present invention. For convenience of explanation, a sound generating member is omitted in FIG. 7. FIG. 7 shows a view as viewed directly from above. As shown in FIG. 7, a second pad 310 is disposed on the front cover 230. The second pad 310 may be formed by means of injection molding. A Pogo Pin connector 110 is connected to the second pad 310. The Pogo Pin connector 110 may also be formed by means of injection molding. A piezoelectric buzzer 220 is connected to the second pad 310 through a lead 320.

Figure 8:
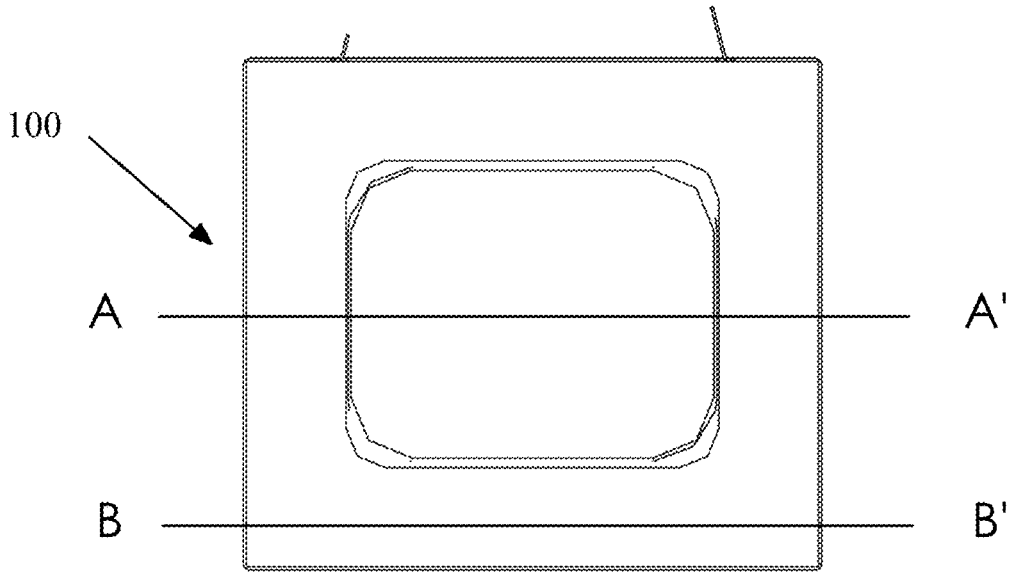
FIG. 8 is a view of a sound generating apparatus as viewed from a front cover side according to one embodiment of the present invention.

FIG. 8 is a view of a sound generating apparatus as viewed from a front cover side according to one embodiment of the present invention.

Figure 9:
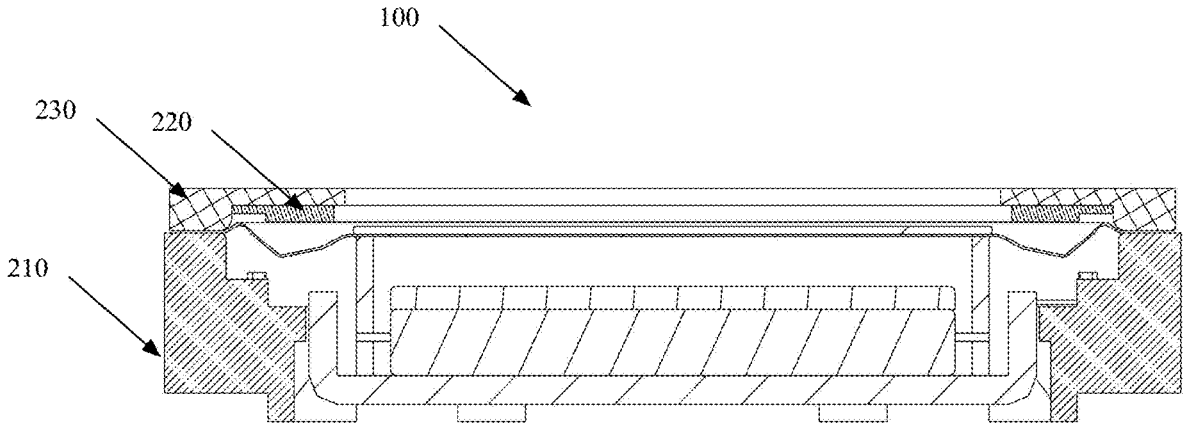
FIG. 9 is a sectional view taken along a line A-A' of a sound generating apparatus in FIG. 8.

FIG. 9 is a sectional view taken along a line A-A' of a sound generating apparatus in FIG. 8. As shown in FIG. 9, the sound generating apparatus 100 includes a sound generating member 210, a piezoelectric buzzer 220 and a front cover 230. Since the sound generating member 210 itself is not of interest in the present invention, it is not described in detail herein. In an example of FIG. 9, the piezoelectric buzzer 220 is attached to the inner side of the front cover 230. Alternatively, the piezoelectric buzzer 220 may also be attached to the outer side of the front cover 230.

Figure 10:
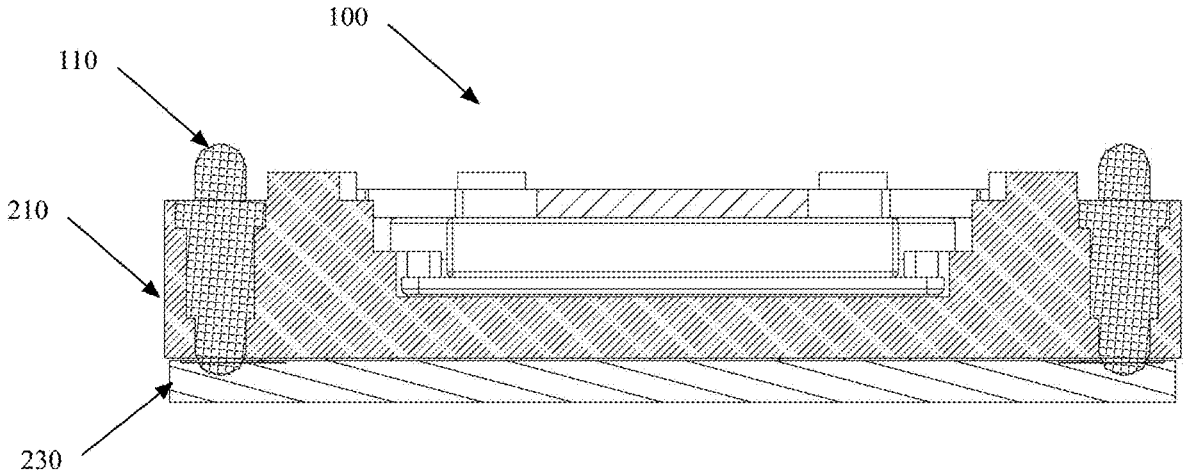
FIG. 10 is a sectional view taken along a line B-B' of a sound generating apparatus in FIG. 8.

FIG. 10 is a sectional view taken along a line B-B' of a sound generating apparatus in FIG. 8. A sound generating member 210 and a front cover 230 are shown in FIG. 10. A Pogo Pin connector 110 is in contact with a pad (not shown) on the front cover 230 through the sound generating member 210.

In another embodiment, the present invention also includes an electronic device. The electronic device includes, for example, the sound generating apparatus according to the present invention. The electronic device is, for example, a media device. For example, the electronic device is a mobile phone. For example, the sound generating apparatus is, for example, a speaker, an earphone, or the like in the mobile phone.

Figure 11:
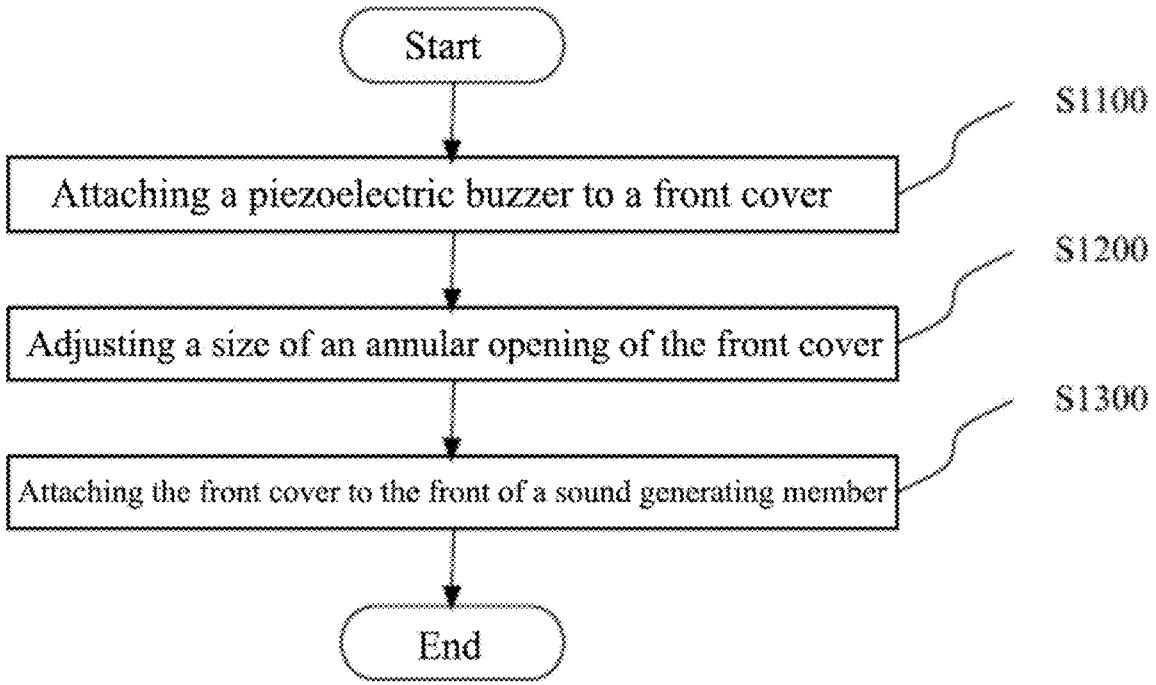
FIG. 11 is a flow chart of a method for manufacturing a sound generating apparatus according to another embodiment of the present invention.

FIG. 11 is a flow chart of a method for manufacturing a sound generating apparatus according to another embodiment of the present invention. For example, the sound generating apparatus includes a sound generating member, a piezoelectric buzzer and a front cover, and the sound generating member and the front cover form a Helmholtz resonator.

As shown in FIG. 11, in step S1100, the piezoelectric buzzer is attached to the front cover. For example, the piezoelectric buzzer is annular and the front cover is also annular. For example, an annular opening of the piezoelectric buzzer and an annular opening of the front cover are at least partially overlapped.

In step S1200, a size of the annular opening of the front cover is adjusted so as to adjust a resonant frequency of a Helmholtz resonator. Here, the annular opening of the front cover may refer to an opening as viewed from a front cover side toward a sound generating member. For example, the size of the annular opening of the front cover may be a size of an opening jointly formed by the piezoelectric buzzer and the front cover. Alternatively, if the annular opening of the piezoelectric buzzer is smaller than the annular opening of the front cover, the annular opening of the piezoelectric buzzer may be adjusted at the same time. Alternatively, the size of the annular opening of the front cover may be adjusted by adjusting relative position of the front cover and the piezoelectric buzzer.

In step S1300, the front cover is attached to the front of the sound generating member.

Although steps S1100, S1200 and S1300 are shown in FIG. 11, this only indicates that the method according to the present invention may include these steps without indicating that the above steps must be performed in the order described. For example, step S1200 may be performed before step S1100; or step S1200 may be performed after step S1300. In addition, for example, in a case where the piezoelectric buzzer is attached to the outer side of the front cover, the step S1100 may be performed after the step S1300.

Although some specific embodiments of the present invention have been demonstrated in detail with examples, it should be understood by a person skilled in the art that the above examples are only intended to be illustrative but not to limit the scope of the present invention. It should be understood by a person skilled in the art that the above embodiments can be modified without departing from the scope and spirit of the present invention. The scope of the present invention is defined by the attached claims.

What is claimed is:

1. A sound generating apparatus, comprising a sound generating member, a piezoelectric buzzer and a front cover, wherein the front cover is attached to the front of the sound generating member, the piezoelectric buzzer is attached to the front cover with a gap therebetween in such a way that the piezoelectric buzzer can interact with the front cover during operation, a resonant frequency of the piezoelectric buzzer is less than or equal to a high-frequency cutoff frequency of the sound generating member, the piezoelectric buzzer and the front cover each are of an annular shape which is periphery-closed and middle-opened, the sound generating member and the front cover form a Helmholtz resonator, and an annular opening formed by the front cover and the piezoelectric buzzer is sized and adjusted by adjustinq a relative position of the front cover and the piezoelectric buzzer, such that a resonant frequency of the Helmholtz resonator is identical to that of the piezoelectric buzzer.

2. The sound generating apparatus according to claim 1, wherein the sound generating apparatus is a moving-coil receiver, and the sound generating member is a moving-coil sound generating portion of the moving-coil receiver.

3. The sound generating apparatus according to claim 1, wherein the piezoelectric buzzer is clung to the front cover.

4. The sound generating apparatus according to claim 1, wherein the piezoelectric buzzer is located on the inner side of the front cover.

5. An electronic device, comprising the sound generating apparatus according to claim 1.

* * * * *